US006558113B2

(12) United States Patent
Blotenberg

(10) Patent No.: US 6,558,113 B2
(45) Date of Patent: May 6, 2003

(54) PROCESS AND DEVICE FOR REGULATING A TURBOCOMPRESSOR TO PREVENT SURGE

(75) Inventor: Wilfried Blotenberg, Dinslaken (DE)

(73) Assignee: Man Turbomaschinen AG GHH Borsig (DE)

( * ) Notice: Subject to any disclaimer, the term of this patent is extended or adjusted under 35 U.S.C. 154(b) by 0 days.

(21) Appl. No.: 09/757,021

(22) Filed: Jan. 8, 2001

(65) Prior Publication Data

US 2001/0014280 A1 Aug. 16, 2001

(30) Foreign Application Priority Data

Jan. 14, 2000 (DE) ..... 100 01 365

(51) Int. Cl.[7] ..... F04D 27/02
(52) U.S. Cl. ..... 415/17; 415/118
(58) Field of Search ..... 415/13, 17, 118, 415/914

(56) References Cited

U.S. PATENT DOCUMENTS 4,142,838 A * 3/1979 Staroselsky ..... 417/20
4,298,310 A 11/1981 Blotenberg
4,656,589 A * 4/1987 Albers et al. ..... 415/1
4,697,980 A * 10/1987 Keyes et al. ..... 415/1
4,789,298 A 12/1988 Blotenberg
4,810,163 A 3/1989 Blotenberg
4,831,534 A * 5/1989 Blotenberg ..... 415/1
4,940,391 A * 7/1990 Elms et al. ..... 417/12
4,968,215 A 11/1990 Blotenberg

* cited by examiner

*Primary Examiner*—Edward K. Look
*Assistant Examiner*—Igor Kershteyn
(74) *Attorney, Agent, or Firm*—McGlew and Tuttle, P.C.

(57) ABSTRACT

To prevent surge of a turbocompressor (K), a anti-surge valve (27) provided at the compressor outlet is controlled by a controller (R). The input signal for the controller (R) is generated as a function of the instantaneous flow and the end pressure of the compressor (K) such that the controller responds more slowly to working point shifts in the direction of the surge limit line and more rapidly to working point shifts in the opposite direction. This is achieved by arranging an asymmetric time element or a gradient sensor in the circuit generating the input signal for the controller (R).

8 Claims, 7 Drawing Sheets

PROCESS AND DEVICE FOR REGULATING A TURBOCOMPRESSOR TO PREVENT SURGE

FIELD OF THE INVENTION

The present invention pertains to a process for regulating a turbocompressor to prevent surge in which a difference signal is generated from a continuously determined actual value of an operating variable of the compressor and a set point which depends on the position of the working point in the characteristic diagram and an input signal for the controller, which controller controls a valve branching off from the compressor outlet, is obtained from the difference signal using a time element, as well as to a device for carrying out the process.

BACKGROUND OF THE INVENTION

The jerky or periodic backflow of medium being delivered from the delivery side to the intake side in compressors is called pumping or surge. This state occurs, e.g., if the end pressure is too high and/or the throughput is too low. A surge limit line, which separates a stable range of the characteristic diagram from an unstable range to the left of the surge limit line, can therefore be defined in the characteristic diagram. Operation in the unstable range to the left of the surge limit is not permissible, because severe damage to the machine may occur within a very short time. To avoid surge, i.e., the operation in the unstable range, a anti-surge controller is used, which controls a valve at the compressor outlet, which is connected as a anti-surge valve to the atmosphere or as a recycle valve to the intake side of the compressor. By opening the valve, the flow through the compressor is increased to the extent that the working point always remains within the stable range of the characteristic diagram. A control line (anti-surge or recycle curve) is defined for such a control in the characteristic diagram at a safety margin from the surge limit line. When the instantaneous working point is approaching the control line, the anti-surge or blow-by valve (hereinafter called anti-surge valve only) is more or less opened.

More precisely, such a control operates such that the set point for the flow control is determined from the compressor pressure or from the pressure ratio between the outlet pressure (end pressure) and the inlet pressure, or from a variable derived from this pressure ratio. This set point corresponds to the control line. The measured compressor intake flow is compared with the set point, and the anti-surge valve is adjusted in case of a deviation. If the working point of the compressor is on the control line, the control deviation of the surge limit controller is zero and the anti-surge valve remains in its position. If the working point exceeds the control line in the direction of the surge limit, the controller opens the valve wider, and if the working point is located to the right of the control line, the controller closes the valve.

During normal operation of the compressor, the working point of the compressor is markedly to the right of the control line (the design point is typically 20% to 30% to the right of this) and the anti-surge valve is completely closed. In case of a shift of the working point from this operating state in the direction of the surge limit, a conventional controller begins to open only when the actual value drops below the set point, i.e., when the working point has exceeded the control line in the direction of the surge limit.

Processes of the aforementioned kind for controlling a turbocompressor to prevent surging are described in the present Inventor's earlier U.S. Pat. Nos. 4,298,310, 4,789,298, 4,810,163 and 4,968,215, the entire contents of which are incorporated herein by way of reference.

The aforementioned U.S. Pat. No. 4,298,310 discloses a process in which a difference signal is generated from a continuously determined actual value of an operating variable of the compressor and a set point, which depends on the position of the working point in the characteristic diagram and an input signal for the controller, which controller controls a valve branching off from the compressor outlet, is obtained from the difference signal using a time element. In this prior-art process, the difference signal from the set point and the actual value is sent once without delay and, in parallel thereto, with a delay to a subtraction point, from which the input signal is taken for the controller. This has the advantage that the control circuit can also process rapid, transient changes of the working point with sufficient reliability. The effect of the system is that an additional signal, which causes such a shift of the control line during transient working point shifts that when the working point approaches the control line, the safety margin between the surge limit and the control line is increased and the controller responds sooner as a result, is added to the set point of the controller. The control line is shifted quasi dynamically and a new "dynamic control line" is in effect. The consequence of this is that the safety margin between the control line and the stability limit is markedly greater under transient conditions than under steady-state conditions and the compressor is protected considerably better under such critical conditions.

However, the prior-art process has the drawback that even though the safety margin is increased during transient working point shifts which take place from a steady state in the direction of the surge limit, the controller can follow changes with a delay only, with the time constant set on the time element. The prior-art process is fully effective only when the working point is shifted in the direction of the surge limit from a steady-state working point. By contrast, the prior-art process works only unsatisfactorily in the case of disturbances that lead first to a shifting of the working point away from the surge limit and then again in the direction of the surge limit. When the working point is moving away from the surge limit, the control line is first shifted transiently to the left, with the tendency of being again set at the steady-state value according to a set time constant, i.e., normally over several minutes. A new steady state can be assumed and the prior-art process can show its full effectiveness only after this state has subsided. Until the subsidence of this transient state, the dynamic control line (this is the effective control line) is located to the left of the steady-state control line. The surge limit controller therefore interferes only with the delay, because the working point must be transiently shifted farther in the direction of the surge limit until the controller comes into action.

SUMMARY AND OBJECTS OF THE INVENTION

The basic object of the present invention is to improve a process and a device of the prior-art type such that the advantage of the increase in the safety margin can always be utilized to the full extent, regardless of whether the working point is located before the beginning of the disturbance in a steady operating state or whether transient working point shifts had already taken place before.

According to the invention, a process is provided for regulating a turbocompressor to prevent surge. A difference signal is generated from a continuously determined actual value of an operating variable of the compressor. A set point, which depends on the position of the working point in the characteristic diagram and an input signal for the controller, which controller controls a said valve branching off from the compressor outlet, is obtained from the difference signal using a time element. The difference signal is delayed with different time constants, depending on the direction in which it changes (increase or decrease). The controller responds more slowly to working point shifts in the direction of the surge limit line and more rapidly to working point shifts in the opposite direction.

The invention also provides a device for regulating a turbocompressor to prevent surge, with a measuring transducers for determining the actual value of one or more operating variables characteristic of the working point of the said compressor. A set point transducer is provided with a preset course and a control line in the characteristic diagram of the compressor A difference member is provided for generating a difference signal from the set point and the actual value. A controller generates a control signal for a valve at the compressor outlet. A circuit is provided for generating the input signal for the controller, which circuit contains a time element and to which the difference signal is sent. The time element is an asymmetric time element, whose delay is greater during a change in the difference signal that corresponds to a shift of the working point in the direction of the surge limit line than during a change in the difference signal in the opposite direction.

The time constant of the time element is asymmetric according to the present invention In case of working point shifts in the direction of the surge limit, the time element acts as described in the state of the art. In case of a shift of the working point in the direction of away from the limit line, the time element operates, by contrast, with a markedly smaller time constant. It is guaranteed as a result that the control line follows nearly without a delay in the case of working point shifts away from the boundary line, but with a known, markedly slower time constant in case of a shift in the direction of the surge limit.

In other words, the prior-art surge limit control for turbocompressors with control line set stationarily, which acts at a fixed distance to the right of the surge limit, is expanded according to the present invention with a dynamic control line. This dynamic control line is implemented such that it changes the effective position of the control line during transient shifts of the compressor working point in the direction of the surge limit, doing so such that depending on the rate at which the working point approaches the surge limit, the effective control line is shifted to the right in the characteristic diagram in the direction of the working point, with the consequence that the safety margin between the surge limit and the control line is increased and the surge limit controller will act sooner as a consequence. In case of very rapid shifts of the working point in the direction of the surge limit, the control line is shifted to the right by half the distance between the working point and the steady-state control line, and the shift of the control line is smaller in the case of slower shifts of the working point. If the working point is shifted in the direction of the steady-state control line only very slowly, i.e., over, e.g., 1 hour, the dynamic control line will coincide almost completely with the steady-state control line.

The regulation process according to the present invention is particularly suitable for applications in which a controlled variable, especially the flow signal, is very noisy due to flow whirl at the measuring point. Classical PID (proportional integral derivative) controllers with differentiating algorithms fail in these applications, because the differential component responds to the rate of change of the controlled variable. Differentiating control algorithms are unacceptable in the case of high-frequency signal disturbances (with frequencies of a few Hz) with signal deviations of a few percent, because they lead to considerable changes in the signal of the manipulated variable even during steady-state operation of the machine. They would respond in the vicinity of the design point even during steady-state operation and often prevent the complete closing of the valve during steady-state operation to the right of the control line. However, the valve is to be kept completely closed during steady-state operation for economic reasons. The process according to the present invention offers marked advantages here, because it does not show this disadvantageous effect even in the case of extremely noisy controlled variables.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
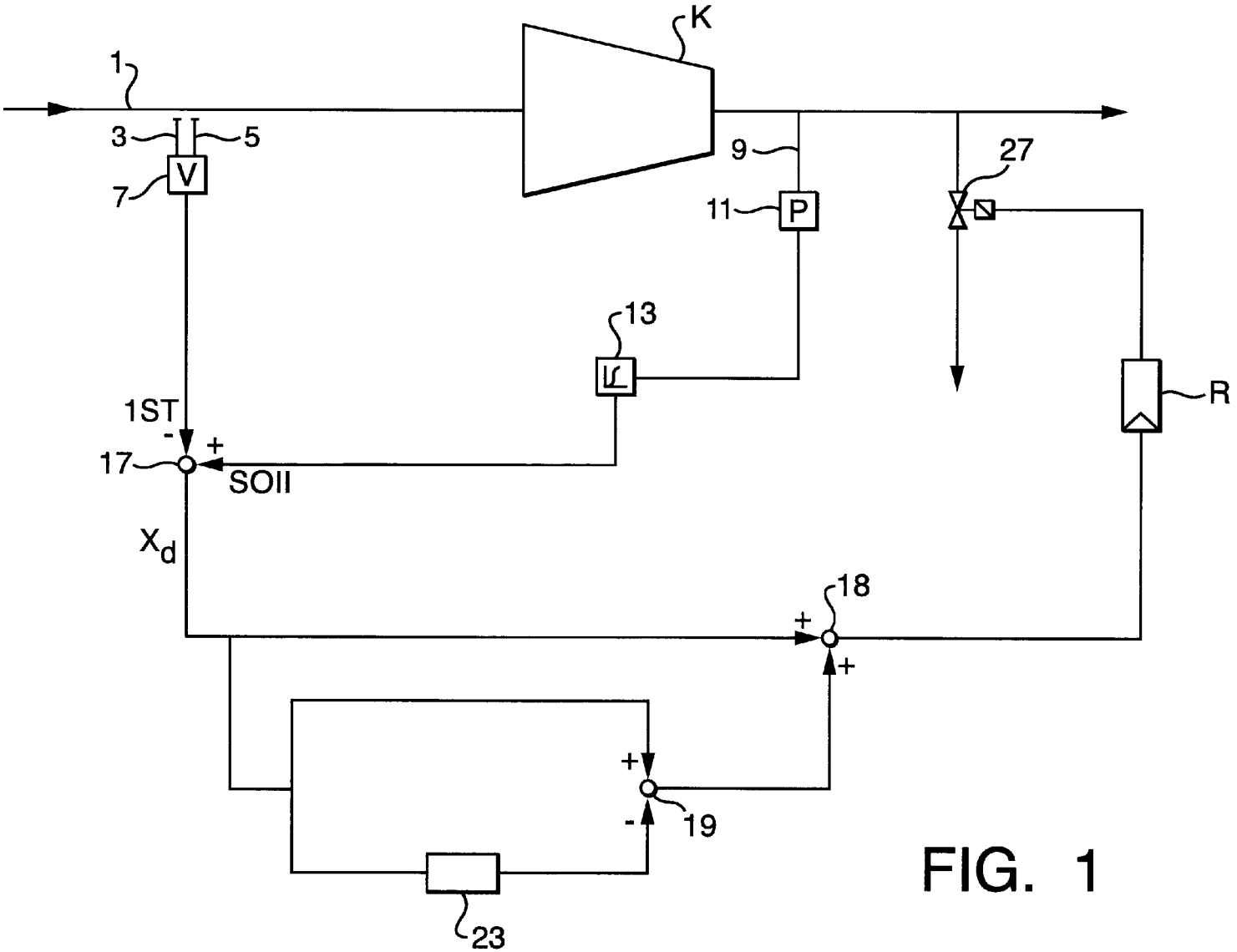
FIG. 1 is a simplified diagram of an embodiment device according to the present invention regulating a turbocompressor to prevent surge.

Referring to the drawings in particular, the embodiment of FIG. 1 is a system in which the pressure before and behind a throttling aperture (not shown) is measured in the suction line 1 of a turbocompressor K by means of measuring sensors 3, 5, and a measuring transducer 7. The actual value for the intake-side compressor throughput V is formed from this measured pressure. At the compressor output, a measuring sensor 9 with a downstream measuring transducer 11 determines the actual value of the end pressure P. Both actual values V and P are sent into a computer 13. The computer 13 is provided with a memory, in which the shape of a steady-state control line (anti-surge line) is stored in the compressor characteristic diagram represented, e.g., by P and V, e.g., as a polygonal course.

The computer 13 determines a set point for the throughput V from the position of the working point, characterized by the pressure at the compressor outlet, in the characteristic diagram relative to the control line, which position is defined by the actual values of V and P. The set point in the universal performance map is generated from the compression head Δh, where $$\Delta h = \frac{k \cdot R \cdot T_1}{k-1}\left[\left(\frac{P_2}{P_1}\right)^{\frac{k-1}{k}} - 1\right]$$

k=isentropic exponent
R=gas constant
$T_1$=inlet temperature at compressor inlet
$P_1$=inlet pressure at compressor inlet
$P_2$=compressor discharge pressure
The pressure $P_2$ can be used as the set point if all other parameters are constant.

The set point and the actual value are sent to a subtracting point 17, which forms a difference signal $x_d$ (deviation). The difference signal $x_d$ is sent to another subtraction point 19 once without delay via a signal path 21 and once with a delay via a time element 23. The difference formed at the subtraction point 19 from the undelayed signal and the delayed signal is sent as an input signal to a controller R, which generates an adjusting signal for controlling a anti-surge valve or blow-by valve 27 present in the output line of the compressor K according to a control algorithm implemented in it in order to perform the surge limit regulation in the known manner. The arrangement corresponds so far to the process known from the aforementioned U.S. Pat. No. 4,298,310.

According to the present invention, the time element 23 is a first-order time element, which has an asymmetric design concerning its time constants. In the case of shifts of the working point to the left in the direction of the surge limit line, i.e., when the change in the difference signal $x_d$ formed at the subtraction point 17 over time is positive, the time element 23 operates with normal delay. If, in contrast, the working point is moving to the right, i.e., away from the surge limit line, and the change in the difference signal $x_d$ formed at the subtraction point 17 over time has a negative sign, the time element 23 operates with a markedly smaller time constant, typically approx. 1 sec. It is thus achieved that the controller R can follow even rapid changes in the working point, which are directed away from the surge limit line G and are therefore "not dangerous," almost without delay.

No differentiating controllers are used in this process according to the present invention. In particular, the control algorithm implemented in the controller R is not differentiating. As was mentioned already, a differentiating controller can be used only if the input signals are extensively free from signal noise. The process operating without differentiating controller according to the present invention can also be used when the input signals have a high percentage of signal noise which is caused, e.g., by whirl formation in the area of the measuring sensors 3 and 5 measuring the flow.

In a more general approach, the circuit branch which is located between the adders 17 and 19 and contains the asymmetric time element 23 can be considered to be a "gradient sensor," with which the direction and the rate of the working point shifts toward or away from the surge limit are detected. The mode of action can be described as follows in this case: The steady-state control line is entered as a polygonal course into the memory 13. The difference between the steady-state control line (set point for the surge limit regulation) and the current flow through the compressor is formed in the adder 17. This (current) control deviation is sent to the controller R, which changes its output according to the implemented control algorithm Furthermore, a virtual control deviation is formed from the current control deviation as a sum from the difference between the steady-state control line and the current flow and the output signal of the gradient sensor 23 by means of the gradient sensor 23 and the adder 19. This virtual control deviation is sent to the controller R as an additional input variable. As a result, a virtual control line is obtained, which follows a transient working point shift with a set time constant (typically 20 to 60 sec). After the subsidence of this time constant, the virtual control line agrees with the steady-state control line.

Various embodiments, which will be explained below, are possible for the gradient sensor, which is represented by the element 23 in FIG. 1.

Figure 2:
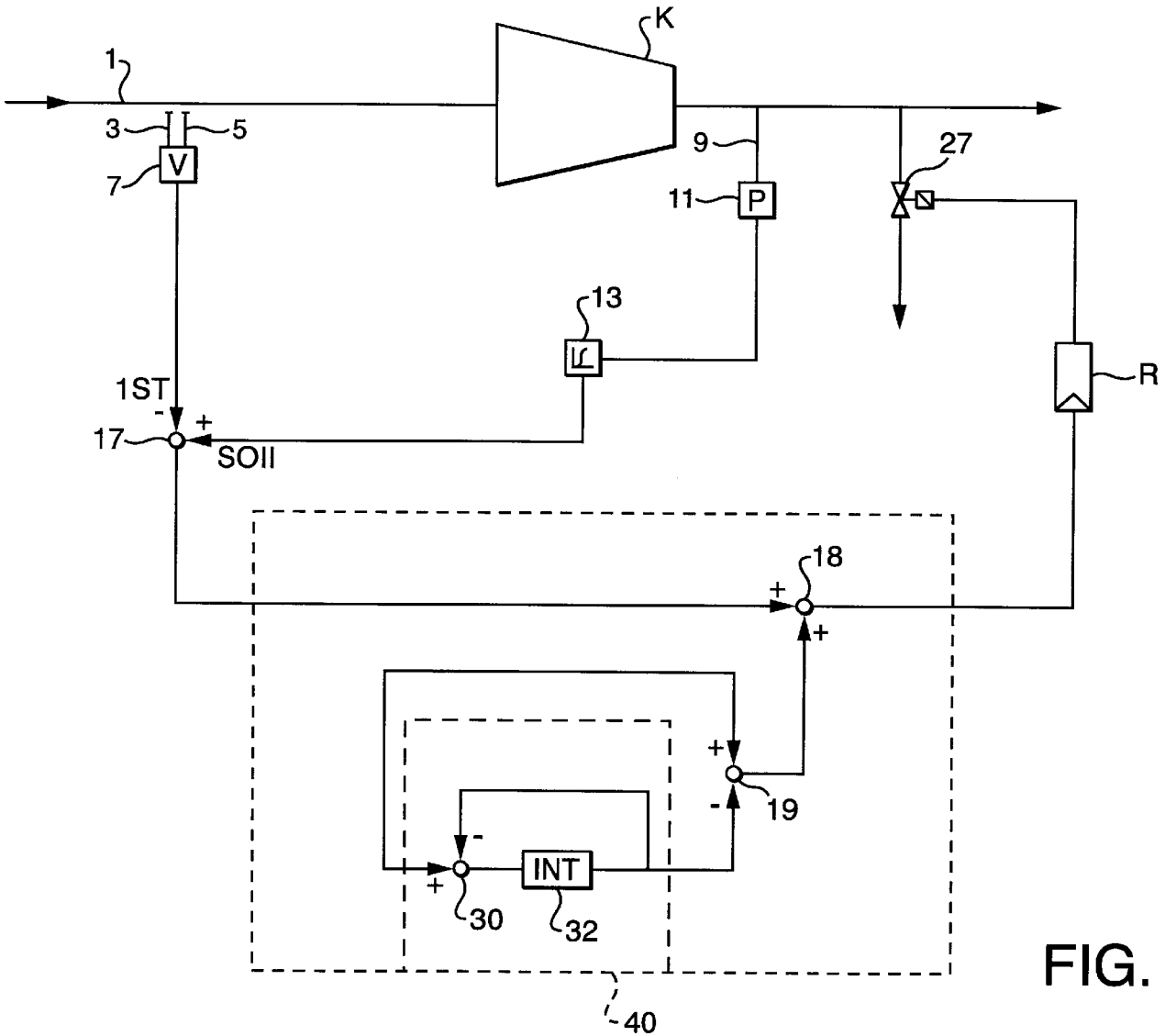
FIG. 2 is a simplified diagram of another embodiment of a device according to the present invention regulating a turbocompressor to prevent surge.

According to FIG. 2, the circuit part 40 acting as a gradient sensor, which is boxed with broken line, contains an integrator 32, whose output signal is fed back to the input and is added with negative sign to the input signal of the integrator 32 by means of an adding member 30. The time constant of this integrator is changed according to the movement of the operating point.

Figure 3:
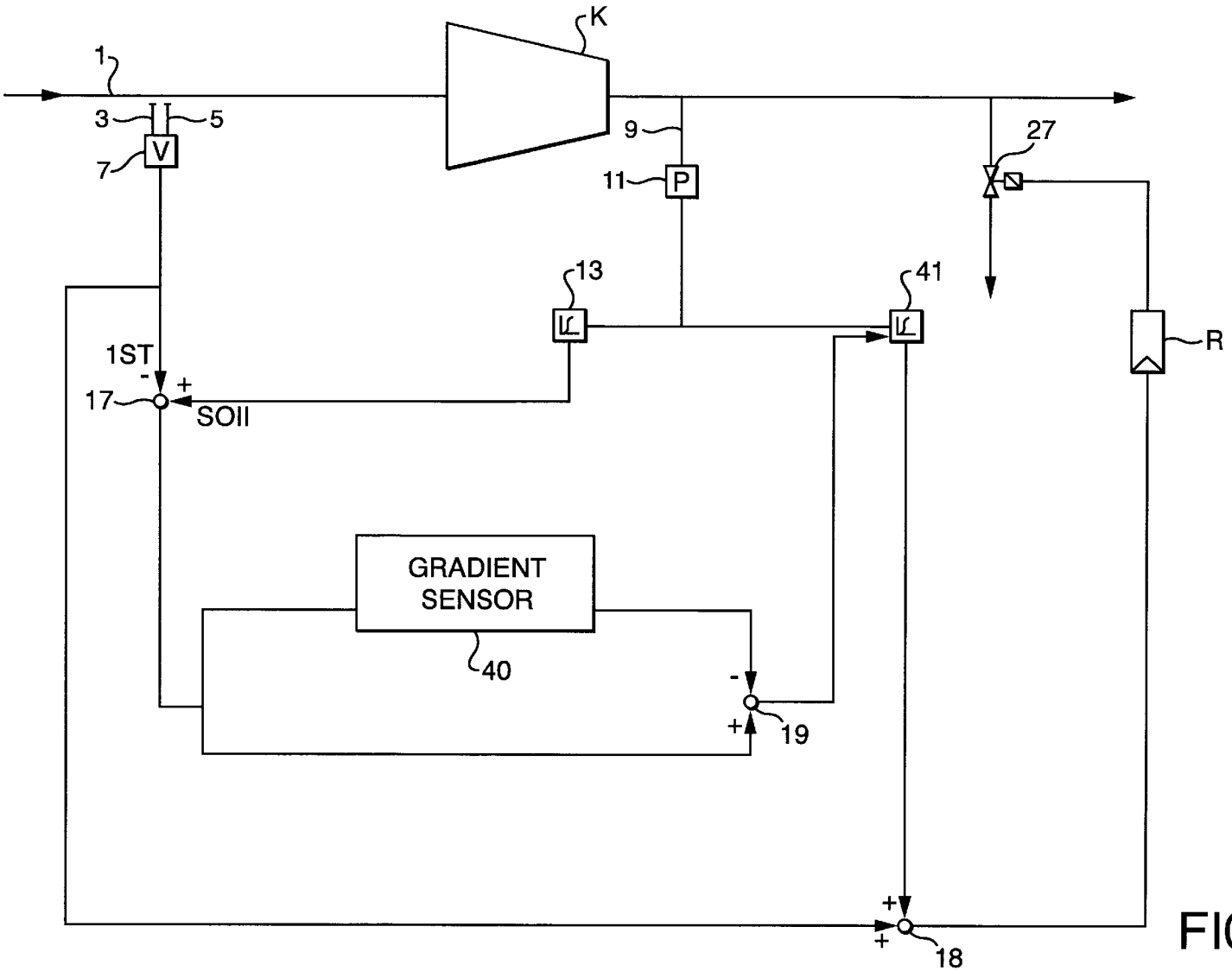
FIG. 3 is a simplified diagram of another embodiment of a device according to the present invention regulating a turbocompressor to prevent surge.

FIG. 3 shows an embodiment in which an additional dynamic control line is preset by an additional function generator (polygon generator) 41 in addition to the steady-state control line preset by the function generator 13. The dynamic control line 41 is formed from the same input variables as the steady-state control line 13, but a "gradient sensor" 40 with a downstream adder 19 shifts the dynamic control line by an amount by which the difference between the steady-state control line and the current flow through the compressor, which difference is formed in the adder 17, changes dynamically. The gradient sensor 40 notes the stationary distance between the steady-state control line and the current intake flow through the compressor and adds this variable to the dynamic control line 41. The difference between the dynamic control line and the current intake flow is formed in the adder 18 and is sent as a control deviation to the controller R, which in turn adjusts the anti-surge/blow-by valve correspondingly. The gradient sensor is designed such that it shifts the dynamic control line only in the direction of greater flows, i.e., toward the safe side for the compressor.

According to the present invention, the gradient sensor follows the new distance between the working point and the control line without delay in the case of a transient shift of the working point away from the surge limit. In the direction of the control line, the output of the gradient sensor follows with a time delay, i.e., slowly, and causes a continuous build-up into the steady state as a result.

Figure 4:
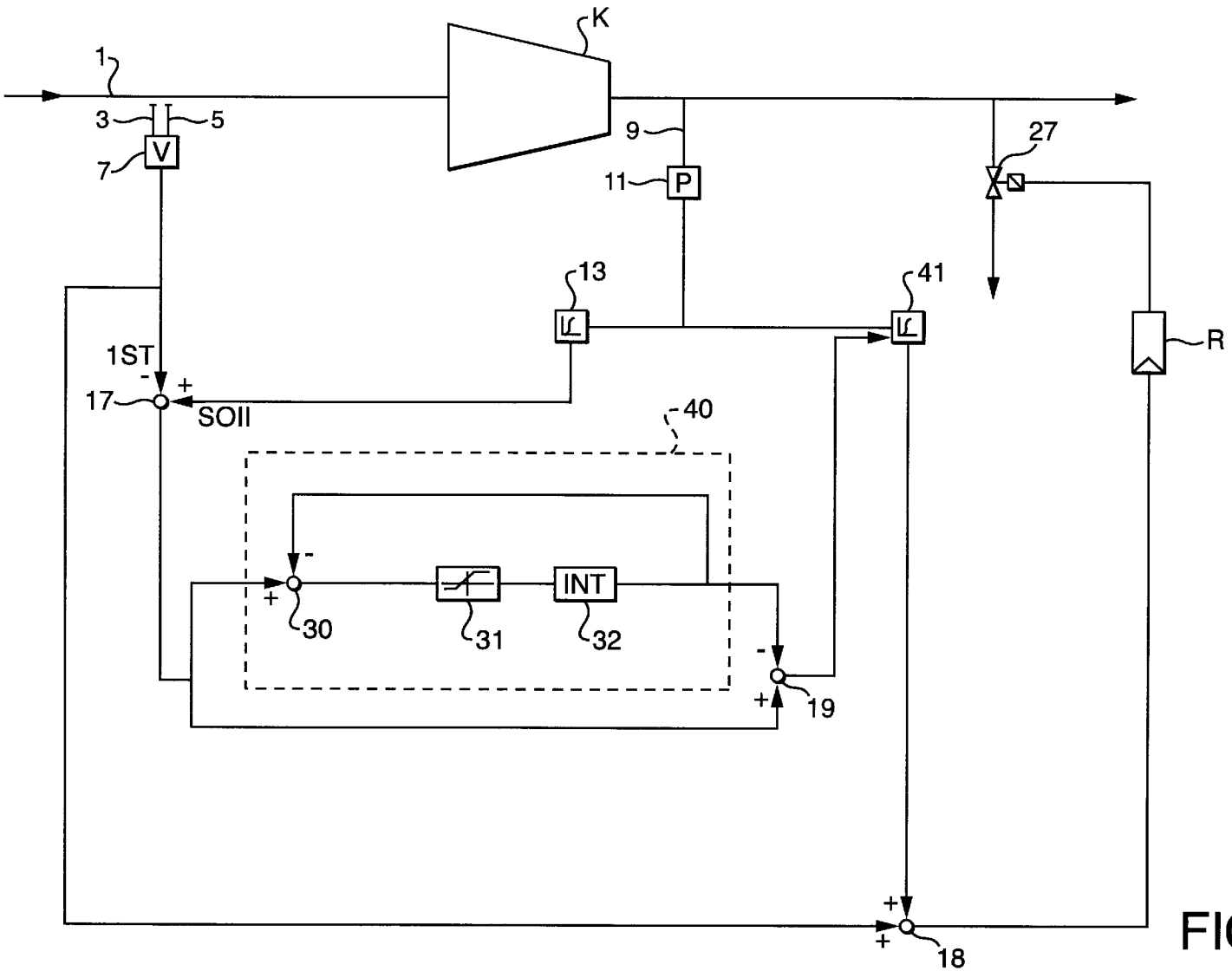
FIG. 4 is a simplified diagram of another embodiment of a device according to the present invention regulating a turbocompressor to prevent surge.

FIG. 4 shows a possible embodiment of the "gradient sensor" as it is inserted into block 40 in FIG. 3. An asymmetric limiter 31 is arranged upstream of a feedback integrator 32. The output signal of the integrator 32 is sent to the adder 30 at the input with a negative sign. The asymmetric limiter 31 is set such that it limits input signals that are generated by a movement of the compressor working point in the direction of the surge limit to very low values, e.g., 0.02. Input signals that correspond to a shift of the compressor working point away from the surge limit are hardly limited, e.g., by a limit of 1.

The effect will be explained on the basis of an example. Let us assume a shift of the compressor working point in the direction of the surge limit, e.g., such that the working point jumps nearly abruptly from a working point located at a distance of 20% from the control line into a point located at a distance of 10% from the control line. Based on the agreement "control deviation xd=set point minus actual value", this means a change in the control deviation xd from −0.2 to −0.1. The output of the integrator 32 equals −0.2 before the beginning of the disturbance, and the input of the adder 30 jumps from −0.2 to −0.1 The output of the adder 30 equals +0.1. Since the limiter 31 limits positive values to a maximum of 0.02, the integrator receives an input signal of 0.02 and integrates as a result with a time constant of 50 sec. The output of the integrator 32 agrees with its input only after the subsidence of this build-up time. The difference between the input of the adder 30 and the output of the integrator is formed in the adder 19 and sent to the dynamic control line. In the steady state, the output of the adder 19 is zero, and during transient shifts of the working point in the direction of the surge limit, the output of the adder 19 transiently assumes a positive value, whose amplitude is proportional to the value of the working point shift and is proportional to the rate of the working point shift.

If the working point is shifted away from the control line, the lower limit of the limiter 31 begins to act and the integrator follows with a short time constant, e.g., 1 sec. Thus, the gradient sensor is nearly ineffective in this direction. However, this has the advantage that the integrator assumes the new steady-state value very rapidly. If the working point changes transiently, i.e., first from −0.2 to −0.3 to subsequently go to −0.1, the output of the integrator follows according to the present invention very rapidly to −0.3. The full dynamics of the system is thus available. In a method according to the state of the art, the integrator would follow the change from −0.2 to −0.3 at the same time constant as in the other direction. The movement away from the control line would be quasi ignored in the case of a short succession of the two disturbances.

Figure 5:
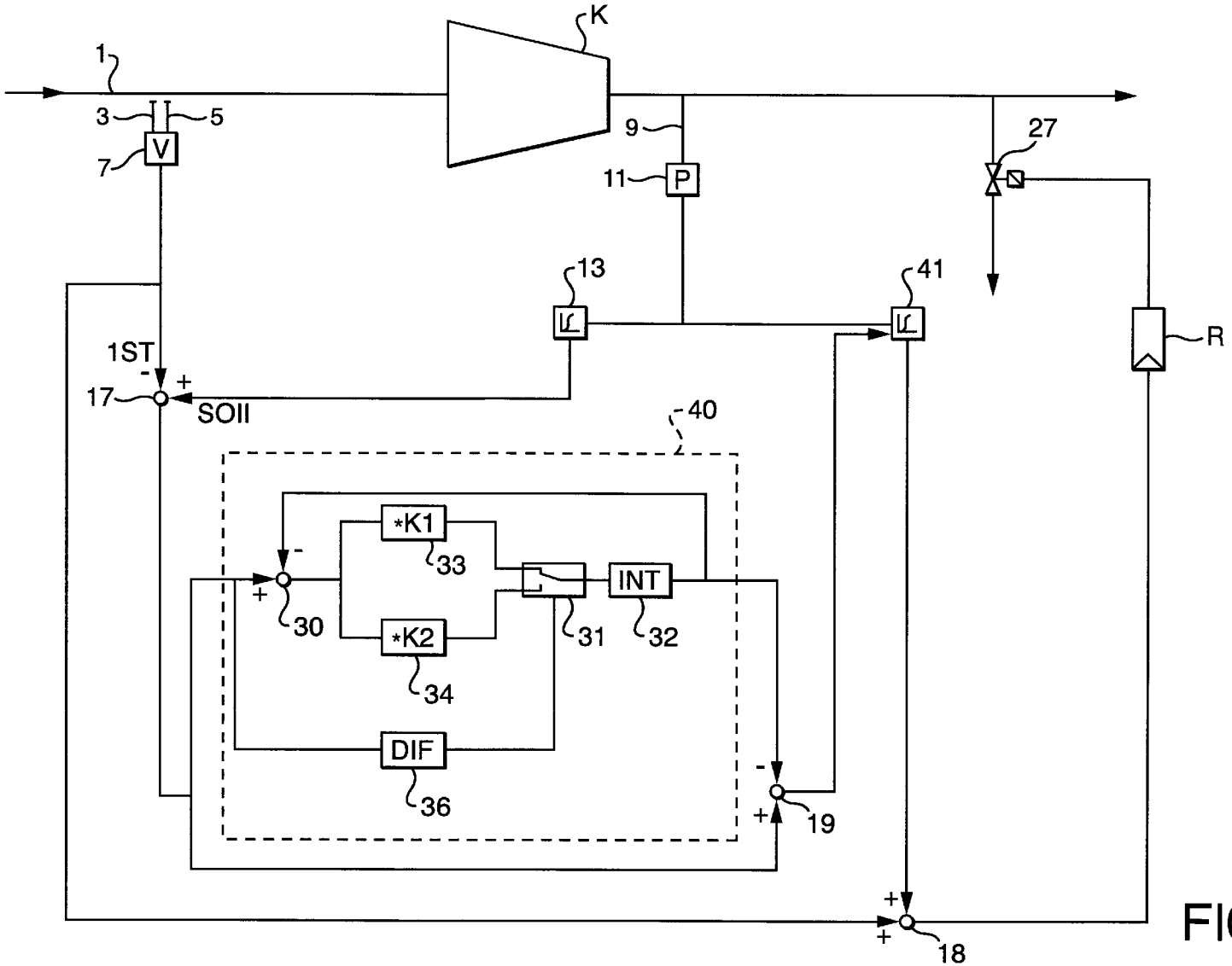
FIG. 5 is a simplified diagram of another embodiment of a device according to the present invention regulating a turbocompressor to prevent surge.

FIG. 5 shows another embodiment of the gradient sensor 40. Instead of the limiter 31, two amplifiers 33 and 34 are used, whose outputs are connected to the integrator 32 via a changeover switch 35. The amplifiers are set to different gain factors; the amplifier 33 to, e.g., 0.02 and the amplifier 34 to 1. The changeover switch 35 is controlled by a differentiator or a sign former 36 and it switches over to one amplifier or the other depending on the sign of the input. It is ensured as a result that a small gain and consequently a high time constant are in effect in case of a working point shift in the direction of the surge limit and there is a high gain, i.e., a small time constant in case of a shift in the direction away from the surge limit.

Figure 6:
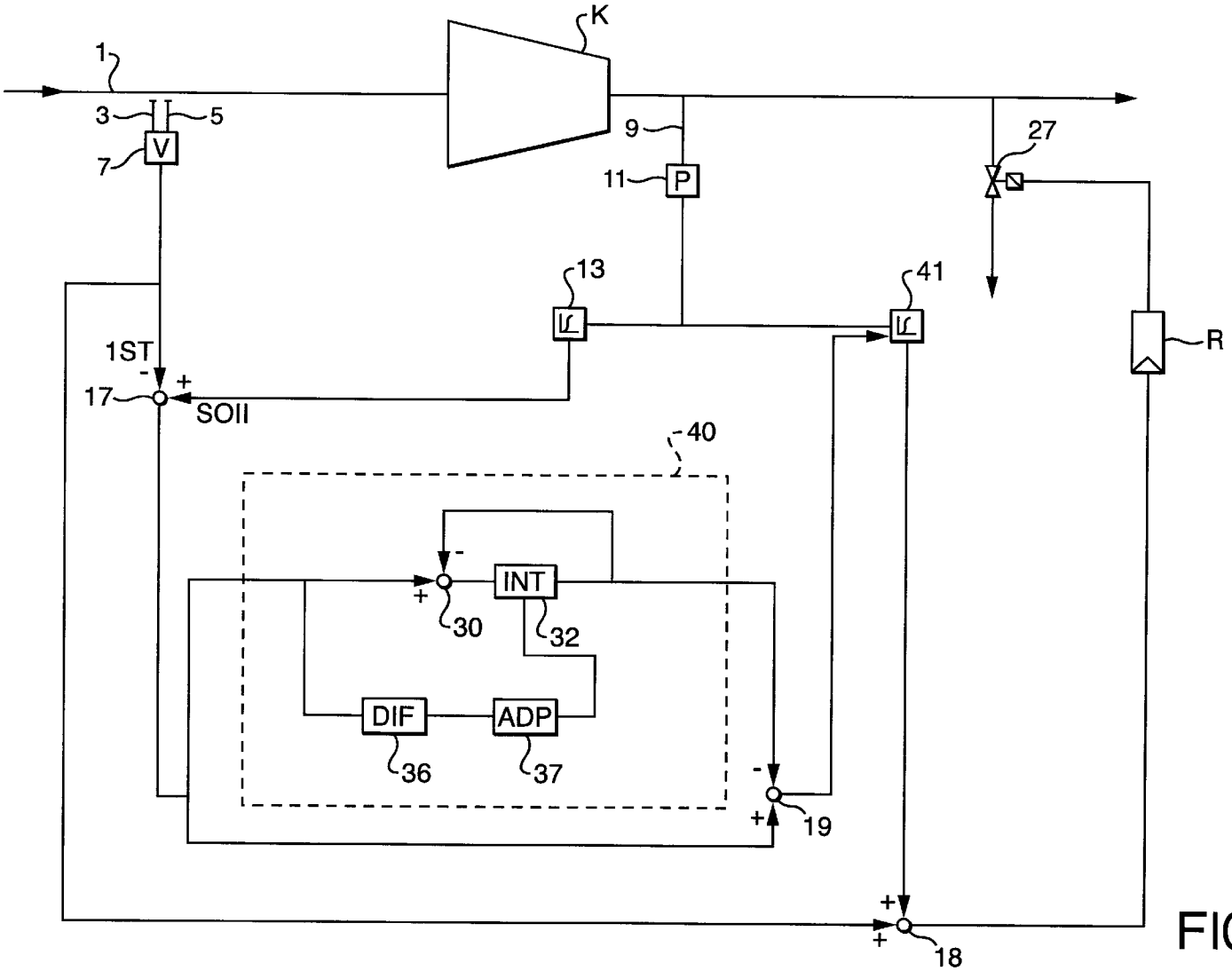
FIG. 6 is a simplified diagram of another embodiment of a device according to the present invention regulating a turbocompressor to prevent surge.

Another embodiment is shown in FIG. 6. Instead of the limiter 31, an integrator 32 with parameter-adaptable time constant is used here. Depending on the direction of the change in the input signal, the time constant of the integrator is switched over via an adaptation block 37 between a high value and a low value.

Figure 7:
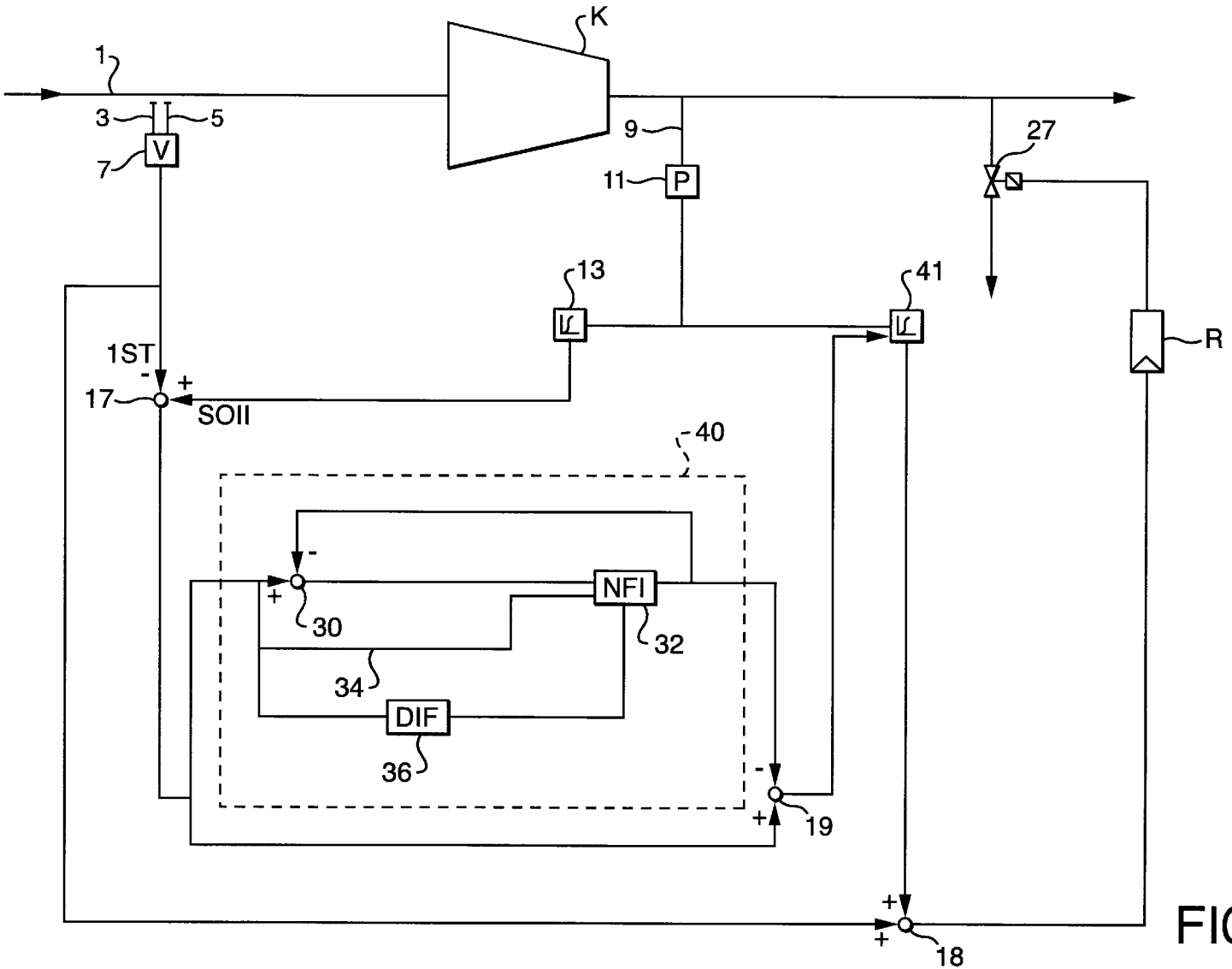
FIG. 7 is a simplified diagram of another embodiment of a device according to the present invention regulating a turbocompressor to prevent surge.

FIG. 7 shows another embodiment, whose gradient sensor 40 uses a special structure-switchable integrator NFI 32. Via a control input, which is connected to the output of the differentiator 36, the integrator switches over between the two modes of operation "Integration" and "Tracking." If the working point of the compressor is shifted in the direction of the surge limit, the differentiator DIF 36 switches the integrator 32 into the mode of operation "Integration." The integrator follows the change in the input signal to the adder 30 with its set time constant (typically e.g., 50 sec). By contrast, if the working point is shifted away from the surge limit, the differentiator 36 switches the integrator 32 into the mode of operation "Tracking." The output of the integrator follows the second input, i.e., the output of the adder 17, without any time delay. As soon as the working point is again moving in the direction of the surge limit, the differentiator 36 again switches the integrator 32 into the mode of operation "Integration." The output of the integrator follows the new value from this state with a set time constant.

This effect shall also be explained on the basis of the following example. When the working point changes transiently, e.g., first from −0.2 to −0.3 to subsequently go to −0.1, the output of the integrator follows according to the present invention very rapidly to −0.3. Since the differentiator 36 detects the shift away from the surge limit, i.e., a change of the control deviation xd from −0.2 to −0.3, the integrator will always assume the same value during this process in the mode of operation "Tracking" as the control deviation, i.e., the output signal of the adder 17. The output of the adder 19 is always zero and the gradient sensor is thus ineffective during a working point shift away from the surge limit.

If, in contrast, the working point is moving in the direction of the surge limit, i.e., the control deviation xd changes from −0.3 to −0.1, the differentiator 36 recognizes the change in direction and switches the integrator into the mode of operation "Integration." The output of the integrator 32 follows the input variable with the set time constant (e.g., 50 sec). As a result, a positive variable is transiently added to the adder 18, which has the same effect as the above-described dynamic control line.

The full dynamics of the system is thus available, because the gradient sensor is effective already at the beginning of the working point shift from the xd=−0.3 position. In a system according to the state of the art, the gradient sensor would shift the control line in the direction away from the surge limit during processes following one another in a rapid succession only at a control deviation of −0.2. In the case of a short succession of both disturbances, the movement away from the control line would be quasi ignored.

The embodiment variants of the gradient sensor 40 shown in FIGS. 4–7 may also be used in the embodiment according to FIG. 2. The gradient sensor 40 comprising the integrator 32 and the adder 30 in the arrangement according to FIG. 2 only needs to be replaced with one of the gradient sensors 40 according to FIGS. 4–7. Such arrangements are not shown in drawings nor described separately here. The advantage of the arrangement according to FIG. 2 over that according to FIG. 3 and its variants according to FIGS. 4–7 is that only one function generator (polygon generator) is necessary to form the steady-state control line, while a function generator (polygon generator) 41 for the dynamic control line is eliminated and the dynamic control line exists only virtually, because it is always calculated as a distance between the steady-state control line and the actual working point.

While specific embodiments of the invention have been shown and described in detail to illustrate the application of the principles of the invention, it will be understood that the invention may be embodied otherwise without departing from such principles.

What is claimed is:

1. A process for regulating a turbocompressor to prevent surge, comprising the steps of:

continuously determining the actual value of an operating variable of the compressor;

continuously determining a set point for said operating variable, the set point depending on the position of the working point in the characteristic diagram, a surge limit line being defined in the characteristic diagram;

generating a difference signal from said actual value and said set point;

delaying the difference signal with an asymmetric time element providing different time constants depending on the direction in which the difference signal changes;

obtaining an input signal for a valve controller from the difference signal ($x_d$) using said asymmetric time element, so that the controller responds more slowly to working point shifts in the direction towards said surge limit line and more rapidly to working point shifts in the opposite direction; and using the controller to control a valve branching off from the compressor outlet.

2. A process in accordance with claim 1, wherein the difference signal is sent to a subtraction point once via the time element and once without delay and the input signal for the controller is taken from the subtraction point.

3. A process in accordance with claim 1, wherein the delay of the time element is nearly zero in the case of working point shifts directed away from the surge limit line.

4. A process in accordance with claim 2, wherein the delay of the time element is nearly zero in the case of working point shifts directed away from the surge limit line.

5. A device for regulating a turbocompressor to prevent surge, the device comprising:

a measuring transducers for determining the actual value of one or more operating variables characteristic of the working point of the compressor;

a set point transducer with preset course and a control line in a characteristic diagram of the compressor;

a difference member for generating a difference signal from the set point and the actual value;

a controller generating a control signal for a valve at the compressor outlet; and a circuit for generating the input signal for the controller, the circuit including an asymmetric time element to which the difference signal is sent, the asymmetric time element having a delay greater during a change in the difference signal in one direction than during a change in the difference signal in another direction.

6. A device for regulating a turbocompressor to prevent surge according to claim 5, wherein said asymmetric time element comprises a gradient sensor determining the value and the direction of the change in the difference signal, and providing an output signal of the gradient sensor controlling a polygon generator, in which a dynamic control line is stored, wherein the sum of the output signal of the polygon generator and the actual value of the compressor throughput is sent as an input signal to the controller.

7. A device for regulating a turbocompressor to prevent surge according to claim 5, wherein said asymmetric time element has a delay greater during a change in the difference signal that corresponds to a shift of the working point in the direction of a surge limit line than during a change in the difference signal in a direction away from surge limit line.

8. A device for regulating a turbocompressor to prevent surge, the device comprising:

a measuring transducers for determining the actual value of one or more operating variables characteristic of the working point of the compressor;

a set point transducer with preset course and a control line in a characteristic diagram of the compressor;

a difference member for generating a difference signal from the set point and the actual value;

a controller generating a control signal for a valve at the compressor outlet; and a gradient sensor determining the value and the direction of the change in the difference signal, and providing an output signal of the gradient sensor controlling a polygon generator, in which a dynamic control line is stored, wherein the sum of the output signal of the polygon generator and the actual value of the compressor throughput is sent as an input signal to the controller.

* * * * *